United States Patent [19]

Schwalm

[11] 4,445,945

[45] May 1, 1984

[54] METHOD OF CONTROLLING FURNACE ATMOSPHERES

[75] Inventor: Donald J. Schwalm, Northville, Mich.

[73] Assignee: Holcroft & Company, Livonia, Mich.

[21] Appl. No.: 481,727

[22] Filed: Apr. 4, 1983

Related U.S. Application Data

[63] Continuation-in-part of Ser. No. 224,849, Jan. 14, 1981, abandoned.

[51] Int. Cl.[3] ..... C21D 1/48

[52] U.S. Cl. ..... 148/16; 148/16.6; 148/20.3

[58] Field of Search ..... 148/16, 16.5, 16.6, 148/16.7, 20.3; 266/80, 81, 82, 85

[56] References Cited

U.S. PATENT DOCUMENTS

| | | | |
|---|---|---|---|
| 2,459,618 | 1/1949 | Carter | 266/81 |
| 2,818,246 | 12/1957 | Kappel | 266/81 |
| 3,693,409 | 9/1972 | Yamagishi | 148/16.5 |
| 4,145,232 | 3/1979 | Solomon | 148/16.5 |
| 4,175,986 | 11/1979 | Ewalt et al. | 148/16.5 |
| 4,249,965 | 2/1981 | Schultz | 148/16.5 |
| 4,288,062 | 9/1981 | Gupta et al. | 266/80 |

OTHER PUBLICATIONS

The Condensed Chemical Dictionary, 8th ed., 1971, p. 452.

*Primary Examiner*—John P. Sheehan
*Attorney, Agent, or Firm*—Barnes, Kisselle, Raisch, Choate, Whittemore & Hulbert

[57] ABSTRACT

Disclosed is a method of controlling the atmosphere of a heat-treating furnace whose atmosphere consists essentially of a carrier gas of CO, $H_2$ and $N_2$ produced from a mixture of methanol and nitrogen. In accordance with the present invention, the ratio of flow of methanol to flow of nitrogen is varied to maintain the CO content of the furnace atmosphere at a predetermined value. This renders more effective the control by conventional means of the flow of additive gases to maintain the carbon potential of the furnace atmosphere at a predetermined value. The flows of methanol and nitrogen may be controlled based on monitored CO content only, or their control may be interrelated to monitored carbon potential as well.

11 Claims, 2 Drawing Figures

METHOD OF CONTROLLING FURNACE ATMOSPHERES

CROSS REFERENCE TO RELATED APPLICATIONS

The present invention is a continuation-in-part of my co-pending application Ser. No. 224,849, filed Jan. 14, 1981 abandoned.

BACKGROUND OF THE INVENTION

In atmosphere type furnaces for controlling the carbon content of steel or cast iron it has been a common practice for the furnace atmosphere to consist essentially of a substantially neutral carrier gas with smaller amounts of carburizing or decarburizing gases, commonly known as enriching or additive gases (typically $CH_4$), added to shift the carbon potential of the active part of the furnace atmosphere as required for the particular process involved. These processes include gas carburization, carbonitriding, carbon restoration, clean or neutral hardening and annealing. Thus at different locations in a continuous furnace or at different times within the cycle of a batch furnace, it may be advantageous to control the atmosphere, or the atmosphere within a particular zone, at different controlled carbon potentials. In any case the steel or cast iron is heated to a controlled high temperature in a furnace containing an atmosphere that will provide carbon to the steel surface, or maintain its carbon content.

In the past a widely used source of carrier gas for furnace atmospheres was formed by thermal decomposition of a hydrocarbon such as natural gas or propane, with a limited amount of air supplied over a nickel catalyst. The resulting gas was commonly known as AGA type 302 endothermic generator gas and when natural gas was used, had a basic analysis (composition) of 20% CO, 40% $H_2$, and 40% $N_2$.

It is currently becoming more prevalent to use a mixture of methanol ($CH_3OH$) and $N_2$ to produce the carrier gas. In the presence of heat, the methanol dissociates into one part CO and two parts $H_2$. By adding two parts gaseous $N_2$ a furnace atmosphere with the same basic analysis as the AGA type 302 endothermic gas, namely 20% CO., 40% $H_2$, and 40% $N_2$, can be produced.

In either case it has of course been recognized that the carbon potential of the furnace atmosphere must be controlled in order to provide the desired amount of carbon at the surface of the metal being treated. The carbon potential determines the ability of the atmosphere to supply, maintain or extract carbon from the surface of the steel or cast iron at the temperature to which it has been heated. This control is normally accomplished by separately controlling the analysis (composition) of the endothermic carrier gas at the generator and measuring one or more constituents of the furnace atmosphere such as, but not limited to, $CO_2$, $O_2$, or $H_2O$ and making suitable adjustments in the feed rate of the additive gas or gases to provide the required carbon potential. This method is based on the assumption that the analysis (composition) of the endothermic carrier gas used remains constant and the constituents in the furnace atmosphere other than the constituent or constituents being measured also remain constant and therefore that the measured constituent or constituents represent a direct relationship to the carbon potential of the atmosphere. The latter portion of this assumption is found to be incorrect because of the well known interaction between the various constituents of the furnace atmosphere.

It was customary in the past when using AGA type 302 endothermic generator gas as the carrier gas to control the analysis of the finished gas leaving the generator by monitoring the $CO_2$ or $H_2O$ (dewpoint) of the finished gas and adjusting the mixture ratio of the air and hydrocarbon used to produce the finished carrier gas. When the carrier gas is supplied as a mixture of methanol and $N_2$, the practice has been to mechanically measure or monitor the feed rate of both constituents and to adjust the ratio of methanol to $N_2$ to provide the constant carrier gas analysis (composition) required. This procedure does not, however, compensate for such contingencies as methanol vapor or $N_2$ bubbles in the liquid methanol supply, variations in the menthanol analysis, incomplete methanol vaporization, or mechanical inaccuracies.

SUMMARY OF THE INVENTION

The present invention relates to an improved method of controlling the atmosphere of a furnace used in heat treating steel or iron in processes wherein a mixture of methanol and nitrogen is used to form a carrier gas for the furnace. The method utilizes the interrelationship between the flow(s) of methanol and nitrogen ($N_2$) and the carbon monoxide (CO) content of the furnace atmosphere, and the interrelationship, on a lower level, between the flow of an additive gas such as methane ($CH_4$) and the CO content of the furnace atmosphere. In the practice of the invention the CO content of the atmosphere is monitored at an appropriate location or locations within the furnace and the flow or flows of methanol and/or nitrogen is adjusted to maintain a desired CO content. At the same time, the amount or flow of additive gas or gases supplied to the furnace to alter the carbon potential of the furnace atmosphere is controlled by separate means responsive primarily to monitored carbon potential.

According to one embodiment of the invention the flows of methanol and nitrogen are adjusted to maintain a desired CO content without regard to the carbon potential of the furnace atmosphere, and the flow of additive gas is adjusted to maintain a desired carbon potential without regard to the CO content of the atmosphere.

According to another embodiment of the invention the CO content and the carbon potential of the furnace atmosphere are separately monitored, and interrelated control of the relative rates of flow of the methanol and the $N_2$ is achieved wherein these rates of flow are responsive to the monitored CO content, but also responsive to changes in the carbon potential (and hence the additive gas flow rate). Similarly, the rate of flow of the additive gas is made primarily responsive to the monitored carbon potential but also responsive to the CO content of the atmosphere.

It is emphasized that this control of the flows of methanol and nitrogen is primarily for the purpose of maintaining the CO content of the furnace at a predetermined value. However, by establishing a condition in which the CO content of the furnace atmosphere is maintained at a predetermined value, the constituent or constituents measured to control the flow of additive gas or gases by conventional practices becomes more representative of the furnace atmosphere's carbon potential. These include measurements of one or more constituents of the furnace atmosphere such as but not limited to $CO_2$, $O_2$, or $H_2O$ (dewpoint) and adjustment of the feed rate of the required additive gas to increase or decrease the carbon potential.

Instead of determining the carbon potential of the existing atmosphere in the furnace as described above, other means of determining the carbon potential may be substituted, such as for example (but not limited to) the well known hot wire method of determination of the carbon potential, or by measuring flame temperature.

In any case it has been found that a much better control of the carbon potential of the furnace atmosphere is made possible when the CO content of the atmosphere is maintained at a predetermined value. Thus, the CO content of the atmosphere may be maintained for example at 20%, and if it drops below this value, the proportion of methanol to $N_2$ is increased.

It is thus recognized that adjustments to the relative flow rates of the methanol and $N_2$ primarily for the purpose of maintaining the CO content at a predetermined value will affect the carbon potential of the furnace atmosphere. Similarly adjustments to the flow of additive gas primarily for the purpose of controlling the carbon potential of the furnace atmosphere will affect the CO content of the atmosphere. The interrelationship between the rates of flow of the three gaseous components of the furnace atmosphere is predictable, and the adjustment of valves controlling these flows can take this into account to anticipate the secondary effects thereof. The mechanism for controlling the valves to regulate the flow of the several gaseous components can but does not necessarily include programmable microprocessors, so that this may be readily accomplished.

IN THE DRAWINGS

FIG. 1 is a diagrammatic illustration of a first embodiment of the invention, and FIG. 2 is a diagrammatic view of a similar system, showing an interconnection between the controls for one constituent of the carrier gas and the additive gas.

DETAILED DESCRIPTION OF PREFERRED EMBODIMENT

Figure 1:
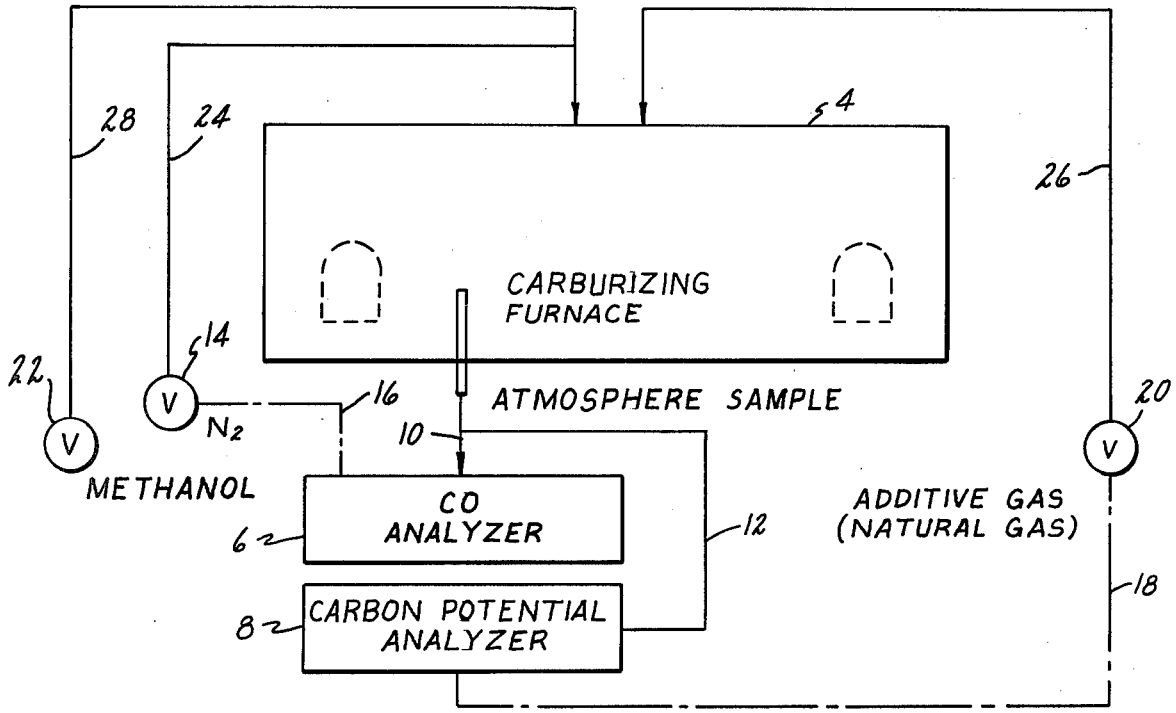

Referring first to FIG. 1, atmosphere samples from a furnace 4 are conducted to CO analyzer 6 such as an infrared analyzer and to a carbon potential analyzer 8 by the conductors shown in full lines at 10 and 12 respectively. As herein illustrated, the CO analyzer 6 is diagrammatically illustrated as connected to an $N_2$ control valve 14 by the dot and dash line 16. The carbon potential analyzer 8 is connected by dot and dash line 18 to a valve 20 for controlling the flow of additive gas (e.g., natural gas or air). The valves 14 and 20, and a methanol control valve 22 control the flow of nitrogen, additive gas, and methanol to the furnace 4 along lines 24, 26 and 28, respectively.

It will be observed that control of $N_2$ valve 14 is without regard to control of the additive gas by valve 20. Similarly control of the additive valve 20 to control the carbon potential of the furnace at the required valve is without regard to the composition of the carrier gas, which however is maintained at a substantially constant CO level by regulation of the $N_2$ valve 14.

The most effective control of carbon potential to maintain it at a desired value is obtained by maintaining the CO content of the carrier gas at a substantially constant predetermined value.

In the diagram of FIG. 1 the CO analyzer 6 is illustrated as connected to control only the $N_2$ valve 14. It will be understood that equivalent results are obtainable by controlling the flow of methanol by regulation of valve 22. Similarly the CO analyzer 6 may control both valves 14 and 22 to vary the methanol/$N_2$ ratio.

Figure 2:
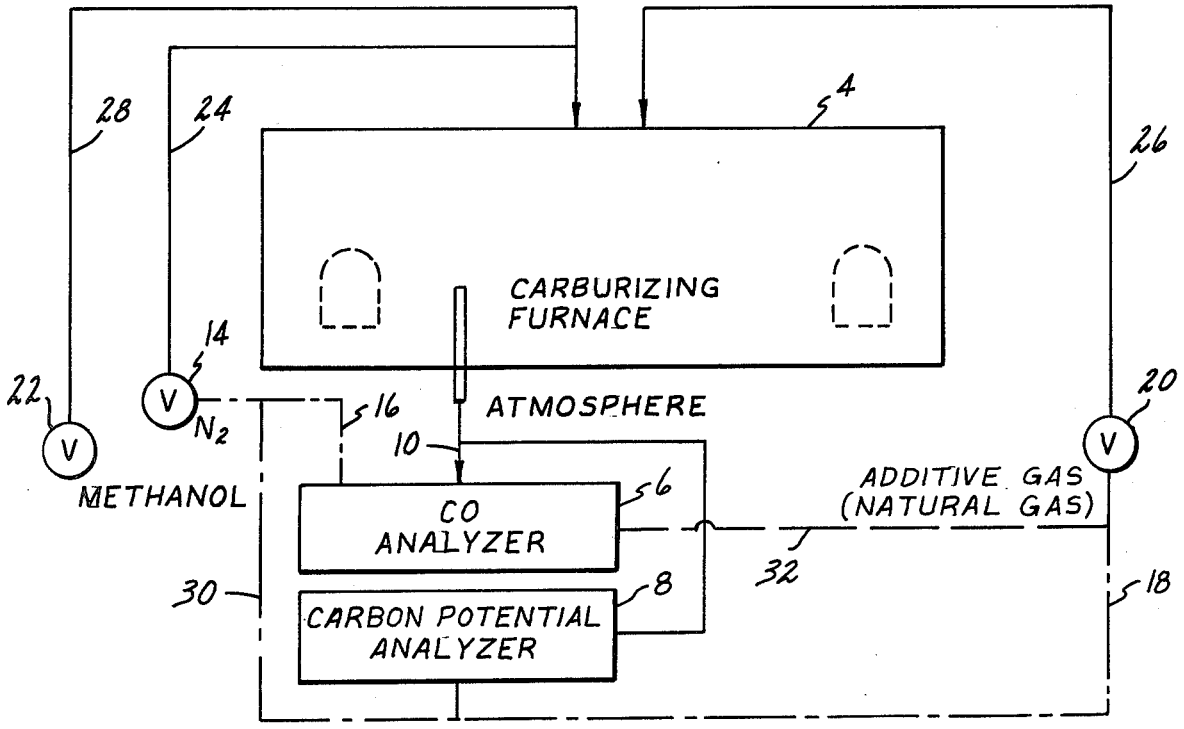

Referring now to FIG. 2, in which like parts are identified as in FIG. 1, there is shown an output line 30 connecting the carbon potential analyzer 8 to the $N_2$ valve 14. This provides for modification of the $N_2$ valve setting in response to a change in flow of the additive gas. Thus, it may be determined empirically that a given change in flow of additive gas will require a change in the ratio of methanol and $N_2$, and this change may be effected simultaneously with the change in flow of additive gas, without awaiting the predictable change in percentage of CO to be sensed by the CO analyzer.

Similarly, a given change in flow of $N_2$ and/or methanol in response to a sensed change in CO content of the carrier gas will have a predictable effect on the carbon potential of the atmosphere, and a connection 32 between the CO analyzer 6 and the valve 20 may effect an empirically determined change in flow of additive gas without requiring the predictable change in carbon potential to be sensed by the carbon potential analyzer 8.

It will be understood that the systems of FIGS. 1 and 2 operate continuously to maintain the carbon potential and CO content at selected predetermined values.

Simplified examples of the operation of the systems of FIGS. 1 and 2 are given below.

EXAMPLE 1

In a furnace, a flow rate of 400 cu. ft. of $N_2$ and 2.68 gallons of properly cracked methanol will produce in a given time and at a given pressure 1000 cu. ft. of carrier gas consisting of 20% CO (200 cu. ft.), 40% $H_2$ (400 cu. ft.), and 40% $N_2$ (400 cu. ft.). If for some reason the flow rate of $N_2$ decreases to 380 cu. ft. per unit time, then the CO fraction will increase to 200/980, or 20.41%. This increase in the percentage of CO will cause the CO analyzer 6 to increase the flow of $N_2$ through valve 14 to restore the CO percentage to 20%.

EXAMPLE 2

With the same conditions as in Example 1, addition of 100 cu. ft. of additive gas ($CH_4$) per unit time to the atmosphere is required for carburizing purposes.

This additive gas is supplied through valve 20 by the carbon potential control system including the carbon potential analyzer 8. By dilution, the fraction of CO will decrease to 200/1100, or 18.18% of the furnace atmosphere.

The decrease in the percentage of CO as sensed by the CO analyzer 6 will adjust the methanol $-N_2$ ratio by reducing the flow of $N_2$ by 100 cu. ft. per unit time, thus providing a CO fraction of 200/1000, or 20% of the furnace atmosphere.

(NOTE: If the control system illustrated in FIG. 2 is utilized—i.e. a system whose $N_2$ valve is connected to the carbon potential analyzer—the required reduction in flow of $N_2$ due to the 100 cu. ft. of additive gas would be anticipated and effected without awaiting the sensing of a decrease in CO content. Final trim of the methanol nitrogen ratio to maintain the CO percentage at 20% would be effected by the CO analyzer through valve 14.)

EXAMPLE 3

Assume the same conditions as in Example 2, plus the existence of 2 cu. ft. of $CO_2$ and 7.9 cu. ft. (+40° dew point) of $H_2O$ vapor in the furnace.

Part of the natural gas ($CH_4$) will react with the $CO_2$ and $H_2O$. Assume that it reacts with 1 cu. ft. of $CO_2$ and 4.5 cu. ft. of $H_2O$ as follows:

| | | | | | | |
|---|---|---|---|---|---|---|
| (a) | $CH_4$ | + | $CO_2$ | $2CO$ | + | $2H_2$ |
| | 1 cu. ft. | | 1 cu. ft. | 2 cu. ft. | | 2 cu. ft. |

Net volume increased 2 cu. ft.

| | | | | | | |
|---|---|---|---|---|---|---|
| (b) | $CH_4$ | + | $H_2O$ | $CO$ | + | $3H_2$ |
| | 4.5 cu. ft. | | 4.5 cu. ft. | 4.5 cu. ft. | | 13.5 cu. ft. |

Net volume increased 9 cu. ft.

The total atmosphere would now be:

| | |
|---|---|
| Original carrier gas | 1000 cu. ft. |
| Natural gas | 100 |
| $CO_2$ | 2 |
| $H_2O$ | 7.9 |
| Reaction (a) | 2 |
| Reaction (b) | 9 |
| | 1120.9 cu. ft. |

The total volume of CO would now be:

| | |
|---|---|
| Original | 200 |
| Reaction (a) | 2 |
| Reaction (b) | 4.5 |
| | 206.5 |

The fraction of CO would be 206.5/1120.9, or 18.42%.

The CO analyzer would reduce the flow rate of $N_2$ to 88.4 cu. ft. per unit time, which would reduce the total atmosphere to 1032.5 cu. ft., of which the CO percentage would be 20%.

EXAMPLE 4

It will be apparent that the CO content in Example 3 could be returned to 20% by increasing the rate of methanol flow. However, the chemical balance is not as straightforward as by reducing the $N_2$ flow. In this case, the change in the flow rate of methanol to correct the CO variation in Example 3 would require an increase in the flow rate of methanol to provide 44 cu. ft. of CO and 88 cu. ft. of $H_2$. This would change the analysis as follows:

CO volume=206.5+44=250.5 cu. ft.

Total volume=1120.9+132=1252.9 for a CO fraction of 250.5/1252.9, or 19.993%.

As previously mentioned, control of CO content may be achieved by controlling $N_2$, methanol, or both. Also as described, the control of the flows of methanol and $N_2$ may anticipate the dilution of change in CO percentage due to changes in the addition of $CH_4$, as illustrated in Example 2. Similarly, the control of flow of $CH_4$ may anticipate changes in carbon potential due to dilution or change resulting from changes in flow of methanol and/or $N_2$.

Practice of the present invention maintains a relatively stable gas analysis when using $N_2$ and methanol to supply the substantially neutral carrier gas, thereby improving the effectiveness of the separate carbon potential control system. This is accomplished by controlling the CO percentage in the furnace atmosphere by adjusting the $N_2$-methanol ratio in response to monitored CO percentage to maintain the percentage of CO in the furnace atmosphere at a substantially constant value.

The present invention is applicable to continuous or batch type processing, and is also applicable to controlling carbon potential at different values during different phases of the processing or in different locations of a furnace through which the metal parts are advanced, either continuously or intermittently.

The rate of addition of the mixture of methanol and nitrogen, as well as the additive gases, must of course take into account the necessity of purging the furnace of undesired impurities or atmosphere constituents introduced as a result of the necessary opening of vestibule doors when metal work pieces are fed to or removed from the furnace, as well as the need to maintain a positive pressure within the furnace to prevent infiltration of contaminants such as oxygen. The overall flow rate can of course be varied either upward or downward in accordance with processing and operational requirements. Thus, the invention is applicable to situations where the overall flow rate is reduced during specific periods in the processing cycle.

Reference herein to monitoring will be understood to encompass continuous or intermittent measurements.

I claim:

1. The method of maintaining a substantially stable gas analysis in the atmosphere of a furnace for controlling the carbon content of steel or cast iron to improve the effectiveness of a separate carbon potential control system, which comprises introducing into the furnace (a) a controlled mixture of methanol and nitrogen to produce a substantially neutral carrier gas atmosphere composed essentially of CO, $H_2$, and $N_2$, and (b) a minor amount of an additive gas to control the carbon potential of the atmosphere, characterized by the steps of maintaining the percentage of CO in the furnace substantially at a predetermined value without regard to the carbon potential thereof by controlling the ratio of methanol and nitrogen introduced into the furnace to form the substantially neutral carrier gas constituent of the furnace atmosphere without regard to the carbon potential of the furnace atmosphere, and controlling the carbon potential by controlling the addition of the additive gas to the furnace atmosphere.

2. The method as defined in claim 1, in which control of the carrier gas is by adjustment of separate valve means which determine the flow rates of methanol and nitrogen to the furnace, which comprises monitoring the percentage of CO in the furnace atmosphere without regard to the carbon potential of the atmosphere, and regulating the valve means which determines the flow rates of the methanol and nitrogen respectively in response to the monitored CO content of the furnace atmosphere.

3. The method as defined in claim 2, in which control of the carbon potential of the furnace atmosphere is by adjustment of separate valve means which determines the flow rate of the additive gas, which comprises separately monitoring the carbon potential of the atmosphere in the furnace, and regulating the valve means which determines the flow rate of additive gas primarily in response to the carbon potential of the atmosphere.

4. The method as defined in claim 3 which comprises modifying the regulation of the separate valve means controlling the relative flow of methanol and nitrogen to take into account the changes in the percentage of CO in the atmosphere resulting from changes in the flow rate of additive gas.

5. The method as defined in claim 3 which comprises modifying the regulation of the valve means controlling the flow of additive gas to take into account the changes in carbon potential resulting from changes in the flow rate of methanol and nitrogen.

6. The method of regulating the atmosphere of a furnace for carbon treating iron or steel in which the furnace atmosphere comprises a major quantity of a substantially neutral carrier gas whose constituents are approximately 20% CO, 40% $H_2$ and 40% $N_2$, and a minor quantity of an additive gas which controls the carbon potential of the furnace atmosphere, which method comprises introducing a mixture of methanol and nitrogen into the furnace, determining the CO content of the furnace atmosphere, controlling the ratio of methanol and nitrogen introduced into the furnace to maintain the percentage of CO in the furnace atmosphere at a predetermined value approximately 20% of the total independent of its carbon potential, introducing an additive gas into the furnace, determining the carbon potential of the atmosphere, and controlling the introduction of additive gas to produce the desired carbon potential of the atmosphere without regard to its CO content.

7. In a heat-treating process wherein flows of methanol and nitrogen are introduced into a furnace to form a carrier gas, and a flow of an additive is introduced into the furnace to control the carbon potential of the furnace atmosphere, an improved method of controlling said furnace atmosphere comprising:

monitoring the level of CO in the furnace atmosphere;

adjusting the flow of either methanol or nitrogen, or both said flows, to maintain the level of CO at a desired level;

separately monitoring the carbon potential of the furnace atmosphere; and adjusting the flow of said additive to maintain carbon potential at a desired level.

8. A method of controlling a furnace atmosphere as in claim 7, wherein said flow of either methanol or nitrogen, or both said flows, are adjusted without regard to the monitored carbon potential of the atmosphere.

9. A method of controlling a furnace atmosphere as in claim 7, wherein said flow of either methanol or nitrogen, or both said flows, are adjusted in response to both the monitored level of CO and the monitored level of carbon potential.

10. A method of controlling a furnace atmosphere as in claim 7, wherein said flow of said additive is adjusted without regard to the monitored level of CO in the furnace atmosphere.

11. A method of controlling a furnace atmosphere as in claim 7, wherein said flow of said additive is adjusted in response to both the monitored level of carbon potential and the monitored level of CO.

* * * * *